United States Patent [19]

Crudo et al.

[11] Patent Number: 5,015,138

[45] Date of Patent: May 14, 1991

[54] MACHINE FOR BOOKBINDING USING FLEXIBLE STRIPS

[75] Inventors: Phillip M. Crudo, Sparks; Scott Foltz, Carson City; Roger F. Lay, Reno, all of Nev.

[73] Assignee: Velobind, Inc., Fremont, Calif.

[21] Appl. No.: 539,971

[22] Filed: Jun. 15, 1990

[51] Int. Cl.[5] ..... B42B 5/14

[52] U.S. Cl. ..... 412/43; 412/7; 412/16; 281/21.1

[58] Field of Search ..... 412/43, 7, 13, 16, 33; 281/21.1; 402/80 R

[56] References Cited

U.S. PATENT DOCUMENTS

| | | | |
|---|---|---|---|
| 3,811,146 | 5/1974 | Abildgaard et al. | 412/43 |
| 3,879,783 | 4/1975 | Giulie | 412/43 |
| 4,354,783 | 10/1982 | Szanto | 412/13 |
| 4,369,013 | 1/1983 | Abildgaard et al. | 412/43 |
| 4,645,399 | 2/1987 | Scharer | 412/16 |
| 4,674,906 | 6/1987 | Abildgaard | 402/80 R |
| 4,685,700 | 8/1987 | Abildgaard | 281/21.1 |
| 4,708,560 | 11/1987 | Abildgaard et al. | 412/7 |
| 4,846,616 | 7/1989 | Abildgaard et al. | 412/7 |
| 4,906,157 | 3/1990 | Todaro et al. | 412/43 |

*Primary Examiner*—Douglas D. Watts
*Assistant Examiner*—Hwei-Siu Payer
*Attorney, Agent, or Firm*—Julian Caplan

[57] ABSTRACT

Supplies used with the machine include sheets with holes at intervals, first plastic strips having flexible studs at the same intervals and second strips having holes at the same intervals. The outside surface of said second strip is formed with grooves to receive the bent excess lengths of the studs. The machine has a platen supporting the sheets and a bridge supporting the second strip. The first strip is installed with the studs through the holes in the sheets and second strip. A rotating cam shaft first pulls a pressure bar against the top of the first strip to compress the sheets between the strips with a pre-determined pressure. Mounted on the cam shaft is a drum cam having a pair of grooves which receive cam followers extending from horizontally reciprocating carriages. Each carriage has a pair of bending rollers which have a path of movement immediately below the bottom surface of the second strip. Continued rotation of the cam shaft after compression of the strips is completed causes the carriages to move toward the center of the machine, the rollers bending the excess stud lengths at right angles and into the grooves.

10 Claims, 4 Drawing Sheets

MACHINE FOR BOOKBINDING USING FLEXIBLE STRIPS

CROSS-REFERENCES TO RELATED APPLICATIONS

This application is a modification of prior apparatus of the assignee thereof, including U.S. patent application Ser. No. 07/313,248, now U.S. Pat. No. 4,906,157 filed Feb. 29, 1989, and U.S. patent application Ser. No. 07/360,880 filed June 2, 1989.

BACKGROUND OF THE INVENTION

1. Field of the Invention

This invention relates to a new and improved apparatus using plastic bookbinding strips wherein the male strip has flexible studs which fit through holes in the sheets to be bound and also through holes in the female binding strip. Longitudinally extending from each hole in the female strip is a groove. When the strips have been compressed together with the sheets therebetween, the ends of the studs projecting beyond the female strip are bent at approximately 90° angles so that the studs snap into the grooves in the underside of the female strip, thereby binding the book. Such strips are shown in U.S. Pat. No. 4,685,700 and particularly FIGS. 23–25.

The apparatus described in this application is a modification of a machine illustrated and described in U.S. Pat. No. 4,354,783 for PUNCHING AND BINDING MACHINE. The latter machine was designed for use with thermoplastic strips wherein the excess stud length was cut off and heads formed on the ends of the cut off strips to bind the sheets in a book. Many of the features of this machine are incorporated in the present machine, as hereinafter described.

2. Description of Related Art

Binding strips using flexible studs are now commonly used. However, commercialization of such studs has heretofore been confined primarily to manual compression of the strips with the paper therebetween and manual bending of the excess stud lengths into the grooves. Mechanisms for bending the studs are shown in the aforesaid U.S. applications, Ser. Nos. 07/313,248 now U.S. Pat. No. 4,906,157 and 07/360,880. The present invention provides a desk top machine in which a motor driven paper punch may be incorporated and wherein the compression of the strips and the bending of the studs are mechanically accomplished either with the use of an electric motor or a manually actuated lever.

SUMMARY OF THE INVENTION

The apparatus of the present invention is preferably motor driven, although it may be manually operated with a lever arm. Preferably the machine incorporates a punch to punch holes in the sheets to be bound, the details of such punch forming no part of the present invention. The female binding strip is received in the machine and punched sheets are supported by a horizontal platen with the holes in the sheets aligned with the holes in the female strip. A male strip is then installed, the studs passing through the holes in the sheets and the holes in the female strip. A pressure bar is then positioned on top of the male strip and, by means illustrated and described in detail in U.S. Pat. No. 4,354,783, the pressure bar is lowered against the male strip, thereby compressing the sheets between the strips at a pre-selected pressure.

A rotatable cam shaft which controls the compression means heretofore described also contains thereon a drum-type cam having two separate grooves therein. Reciprocating transversely of the machine in a direction parallel to the strips is a pair of carriages having cam followers fitting into grooves in the cam which controls their reciprocation. Each carriage has a pair of rollers positioned to engage the end of the studs projecting beyond the female strips and force the ends toward the center of the machine, thereby bending the studs at 90° so that they are forced into grooves in the female strip. Completion of the binding cycle causes the pressure bar to be elevated, thereby releasing the bound book from the machine.

A safety switch is also provided to prevent the machine from operating if the female strip is placed in the machine upside down or in other improper position.

Other objects of the present invention will become apparent upon reading the following specification and referring to the accompanying drawings in which similar characters of reference represent corresponding parts in each of the several views.

IN THE DRAWINGS

DESCRIPTION OF PREFERRED EMBODIMENTS

Book Components

Figure 1:
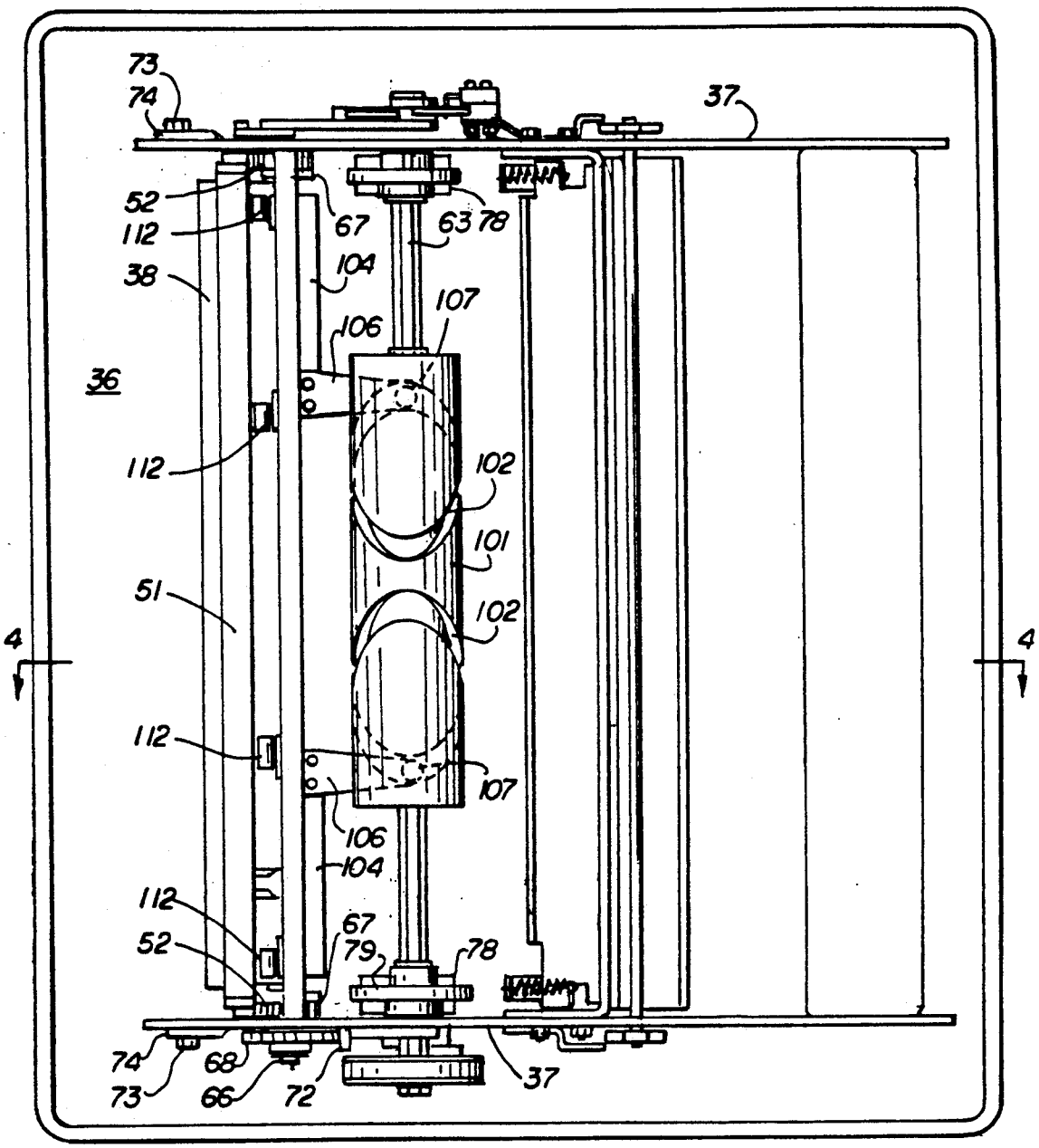
FIG. 1 is a top plan view of the machine with the casing thereof removed to reveal internal construction.
Figure 2:
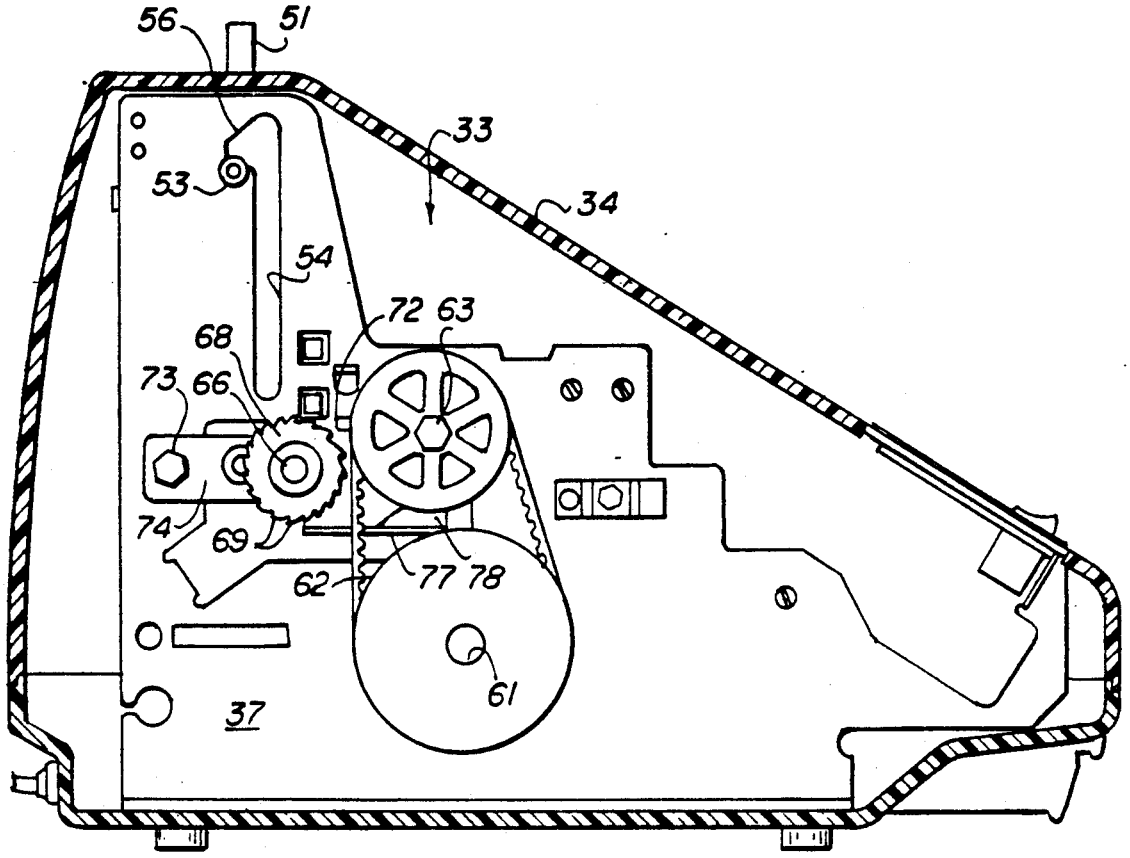
FIG. 2 is a side view from the left of FIG. 1.

The binding strips used in the present apparatus may be in accordance with the FIGS. 23–25 of U.S. Pat. No. 4,685,700 or as shown in U.S. Pat. No. 4,674,906. In essence these are a male binding strip 21 formed of a thin, narrow, plastic material having studs 22 projecting from one surface thereof at intervals. In the preferred embodiment shown there are four such studs 22. The material of which the strip 21 is formed is such that studs 22 may be bent approximately at right angles at any position along the length thereof. Used in conjunction with strip 21 is a female strip 23 having holes 24 spaced the same intervals as studs 22, it being understood that the strip 23 is of the same length and the same width as strip 21 but preferably slightly thicker. For each hole 24 there is a groove 26 formed in the outside surface of strip 23, each groove 26 extending toward the center of strip 23 and communicating with one particular hole 24. The external edges of grooves 26 are formed with lips 27 spaced apart slightly less than the diameter of studs 22.

Sheets 31 of paper, book cover material or the like are formed with holes (not shown) at the same intervals as studs 22. Punching such holes may be performed by the present machine or by other means.

As best shown schematically in FIGS. 6–10, initially sheets 31 are formed in a stack with strip 23 beneath the stack, the holes thereof being aligned with the holes in the sheets 31. Strip 21 is then applied, the studs 22 passing through the holes in sheets 31 and the holes 24 in strip 23. The excess stud lengths 28 project beyond the bottom of strip 23. By means of operation of the machine hereinafter described, the excess stud lengths 28 are bent at right angles (see FIG. 8), the excess lengths 28 snapping between the lips 27 and into the grooves 26. Where four studs 22 are used, the two on each side are bent toward the center. It will be understood the number of studs 22 is optional.

To insure that strip 23 is installed in the machine in proper position, pockets 29 is formed in the inner or upper face thereof, whereas the bottom or outside face is flat. Sensing means (hereinafter described) in the machine insure that the strip 23 is properly installed with the grooves 26 downward or actuation of the machine is inhibited.

Compression Mechanism

The machine shown in the accompanying drawings performs two functions. The first is to punch holes in the sheets 31. This function is not illustrated or described in detail, reference being had to U.S. Pat. No. 4,354,783. The only modification from such a mechanism is that there are but four punches if only four studs 22 are to be used.

The compression and bind functions 33 are likewise embodied in the machine and are enclosed within the same ornamental casing 34.

The machine has a base 36 from which extend vertical opposed side plates 37 which are spaced apart by horizontal transverse cross members 38. Members 38 support a horizontal binding platen 39 having at its rearward edge a depression or recess 41 to receive strip 23, at the level of the top of transverse bridge 42. Rearward of depression 41 is a vertical stop 43 against which the rearward edges of sheets 31 may be squared.

Edge guide 46 on platen 39 is transversely movable to accommodate different widths of sheets 31.

The first step in the operation of the binding mechanism is to place a strip 23 of proper length in depression 41 resting on the tops of rollers 112 (hereinafter described). As hereinafter appears, an interlock prevents strip 23 from being inserted upside down. A stack of sheets 31 is then placed on platen 39 against edge guide 46 and against stop 43, thereby aligning the apertures in the sheets 31 with the holes 24 in strip 23. The male strip 21 is then installed by inserting studs 22 through the apertures in the sheets 31 and through the holes 24.

Pressure Bar

A transverse horizontal, vertically movable pressure bar 51 is provided. Extending downward from bar 51 are racks 52. A roller 53 extends out from the ends of pressure bar 51 and fits into slots 54 which extend approximately vertically in side plates 37. At the top of each slot 54 is a rearward offset 56. When roller 53 is in offset 56, the pressure bar 51 is held in upward position. However, when bar 51 is lifted and moved forwardly so that roller 53 slides down into slot 54, the bottom edge of bar 51 may be brought into contact with the top of strip 21.

A binding motor (not shown) is mounted on one of the side plates 37 and its shaft 61 by means of belt drive 62 turns transverse horizontal cam shaft 63. Shaft 63 is supported between the plates 37.

Figure 11:
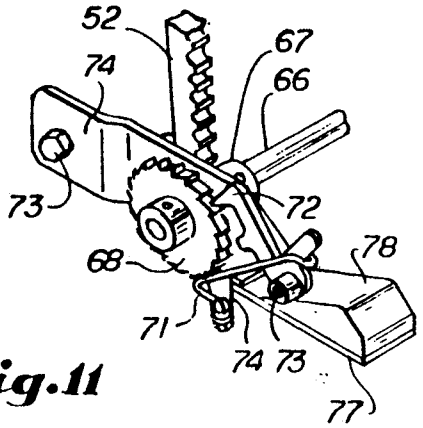
FIG. 11 is a fragmentary perspective view of the pressure bar pull-down mechanism.

As best shown in FIG. 11, a horizontal transverse floating shaft 66 carries pinions 67 which mesh with the teeth of the racks 52. Also on shaft 66 is ratchet wheel 68 which is engaged by pawl 72 biased into engagement with the ratchets 69 by spring 71. Pawl 72 is pivoted on pivot 73 to spring anchor 74. Shaft 66 is supported on either side of the machine by spring anchors 74 pivoted on pivots 76 mounted on plates 37. On the upward end of spring anchors 74 are flat springs 77 which carry cam followers 78 which are engaged by pressure cams 79 on shaft 63.

As shaft 63 revolves, followers 78, which engage pressure cams 79, are increasingly depressed, thus pulling racks 52 downward, causing pressure bar 51 to be forced against strip 21 until a pre-selected pressure is reached, whereupon springs 77 flex and, despite continued turning of cams 79, no greater pressure is applied to strip 21.

Figure 3:
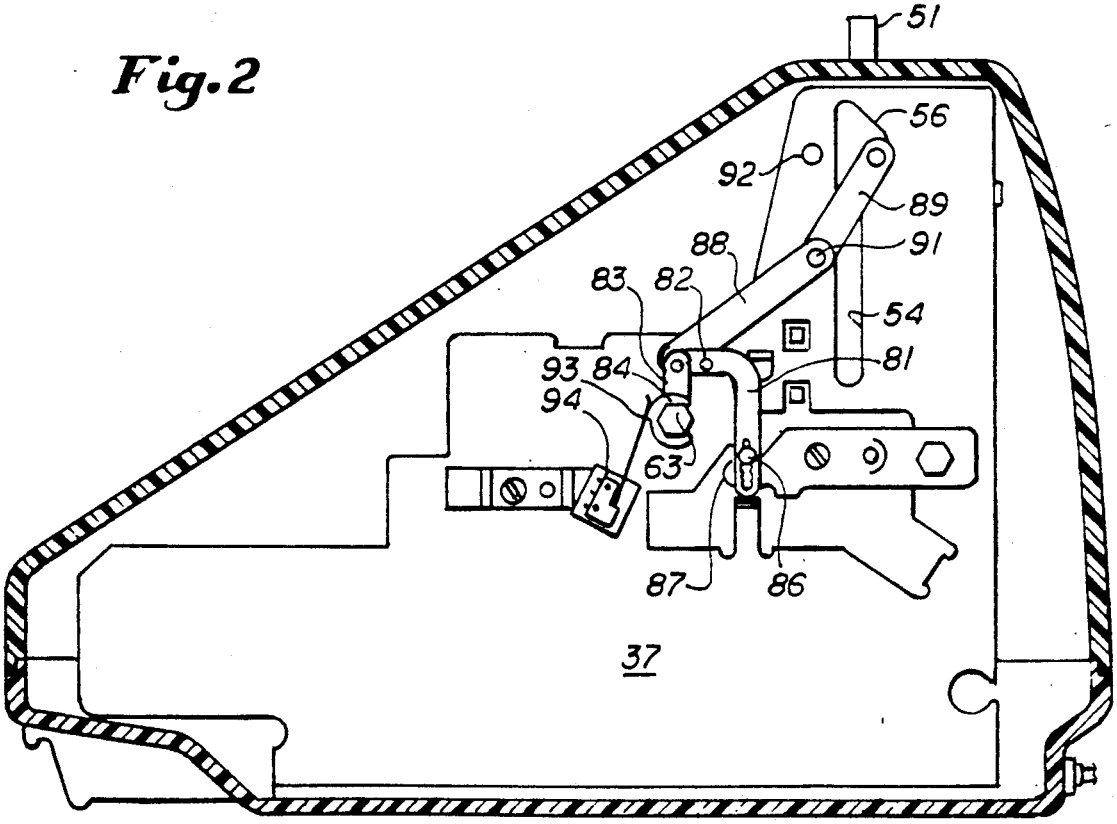
FIG. 3 is a side view from the right.
Figure 4:
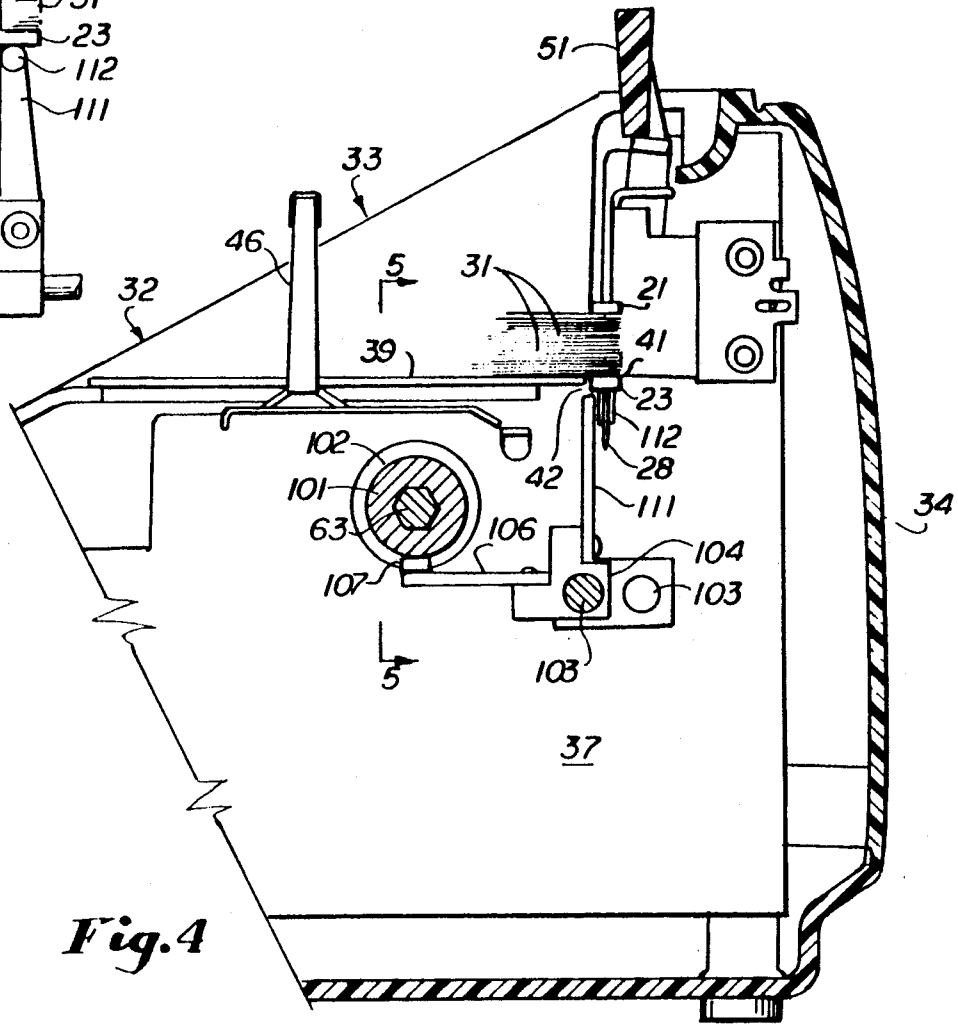
FIG. 4 is a sectional view taken substantially along the line 4—4 of FIG. 1.
Figure 5:
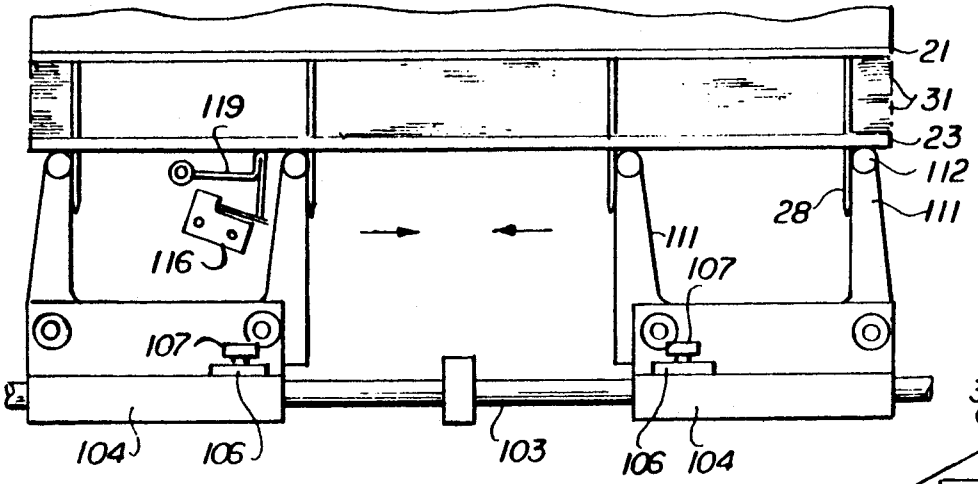
FIG. 5 is an enlarged sectional view taken substantially along the line 5—5 of FIG. 4.

As an optional feature of the apparatus, means may be provided to automatically return pressure bar 51 to upper position. On either side of the machine is angular return arm 81 pivoted by pivot 82 to side plate 37. On the forward end of arm 81 there is a gear segment 83 consisting of approximately two teeth. Fixed for movement with shaft 63 is a meshing gear segment crank 84, also having approximately two teeth. Adjustably positioned on the lower end of return arm 81 is a roller 86. The rest position of arm 81 is determined by stop 87. Pivoted to plate 37 is a first pressure bar link 88 which is pivoted to a second pressure bar link 89 by pivot 91. The upper end of link 88 is connected to the pressure bar by the same means which connects roller 53. A stop 92 is fixed on plate 37 to limit clockwise movement of link 89 as viewed in FIG. 3.

As the binding cycle is completed, rotation of shaft 63 causes the driver gear segment 84 to mesh with gear segment 83 and this causes counterclockwise rotation of return arm 81 about pivot 82. Roller 86 engages link 88 and oscillates it around the shaft of gear segment 83 and this causes link 89 to raise the pressure bar 51 to upper position and drop the roller 53 into the offset 56, causing pressure bar 51 to remain in rest position until the operator initiates the next binding cycle of the machine. Meanwhile, continued rotation of shaft 63 brings gear segments 83 and 84 out of mesh with each other. Whereupon, return arm 81 drops to initial position with its lower end resting on stop 87.

Carried on shaft 63 is a cam 93 which engages the actuator of switch 94 after the gear segments 83 and 84 have ceased to mesh. Switch 94 stops rotation of the motor shaft 61.

Stud Bending Mechanism

Mounted on cam shaft 63 is a horizontally disposed drum cam 101 having two grooves 102 formed therein. The shape of grooves 102 controls the bending of the excess stud length 28. Behind cam 101 is a pair of horizontal transverse rods 103 on which is mounted for horizontal reciprocation a pair of carriages 104. Each carriage has a forward extending arm 106 on the forward end of which is a cam groove follower 107 which fits into the groove 102 on the underside of cam 101.

On the back of carriages 104 are vertical arms 111 on the upper ends of which are rollers 112 spaced immediately below the bottom of strip 23.

Figure 6:
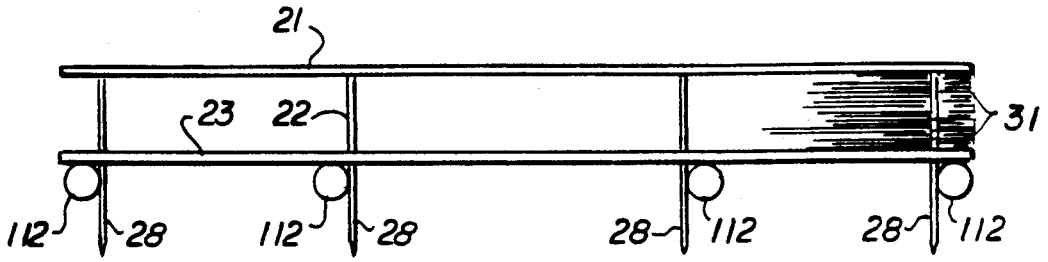
FIG. 6 is a schematic view showing strips at the commencement of the binding cycle.
Figure 7:
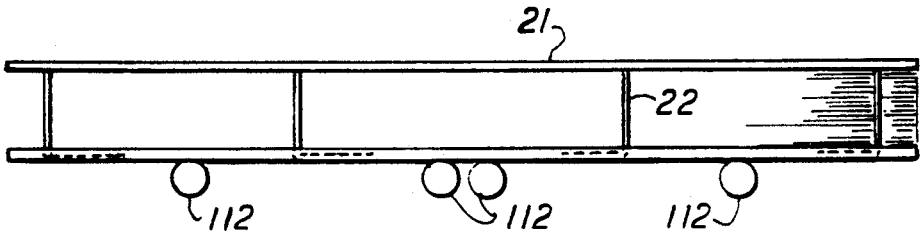
FIG. 7 is a view similar to FIG. 6 showing completion of the binding operation.
Figure 8:
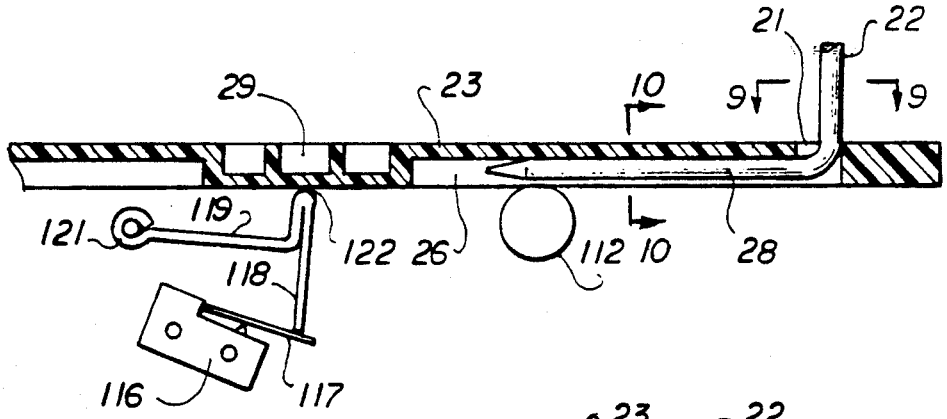
FIG. 8 is an enlarged fragmentary sectional view showing a stud bent into the groove of a strip.
Figure 9:
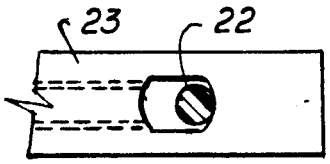
FIG. 9 is a sectional view taken substantially along the line 9—9 of FIG. 8.
Figure 8A:
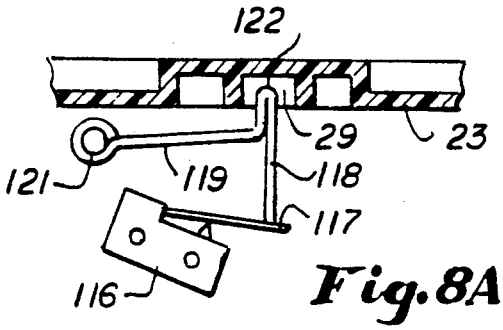
FIG. 8A is a fragmentary view showing a portion of the structure of FIG. 8 with the binding strip inverted.
Figure 10:
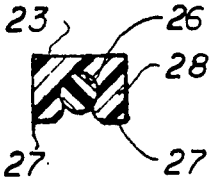
FIG. 10 is a sectional view taken substantially along the line 10—10 of FIG. 8.

After the pressure bar 51 has compressed the strips 21 and 23 toward each other, continued rotation of cam 101 causes the cam followers 107 fitting into the grooves 102 to move the carriages 104 from their retracted position shown in FIG. 1 toward the middle of the machine. Thus, as best shown in FIGS. 6–8, at the commencement of the binding cycle, the rollers 112 are behind (outside of) the excess stud lengths 28. As the carriages 104 move toward the center of the machine, the rollers 112 move inward from the position of FIG. 6 to the position of FIG. 7. As best shown in FIG. 8, this movement of the rollers 112 causes the excess stud length 28 to be bent at right angles from their original position so that the lengths 28 snap between the lips 27 and seat in the grooves 26.

At the conclusion of the binding cycle, the shaft 63 returns to its initial position and the grooves 102 return the rollers 112 to the position shown in FIGS. 1 and 6.

Although cam shaft 63 is described herein as motor driven, it will be understood that the shaft may be manually rotated.

Safety Switch Interlock

If strip 23 were inverted, then there would be no grooves 26 available into which excess lengths 28 fit and the machine would be damaged. To prevent such improper operation, an interlock is provided. Thus pockets 29 are formed in the normally upward surface of strips 23, displaced longitudinally relative to grooves 26, but if the strip were inverted such pockets would be downward facing.

A normally open microswitch 116 is mounted at a convenient location on the frame of the machine, and as illustrated is on the back. Switch 116 has an actuating lever 117 in contact with the lower end 118 of contactor wire 119, the opposite end of which is pivoted to the frame by pivot 121. An intermediate portion or feeler 122 of wire extends upward and is shaped and positioned to fit into a pocket 29 of the strip 23 is inverted from its proper position. If strip 23 is in its proper position, then feeler 122 is depressed by strip 23 because there is no pocket 29 into which it can enter. Depression of feeler 122 depresses lower end 118 which, in turn, depresses lever 117 thereby closing switch 116 and by circuitry not illustrated causing the drive motor of the machine to be energized.

What is claimed is:

1. A binding machine for sheets having first holes, a female strip having second holes and inward extending grooves communicating with the second holes formed on the outside surface of the female strip and a male strip having flexible studs passing through the first and second holes comprising a frame having a platen to support the sheets formed with a depression to receive the female strip, compression means on said frame to compress said strips toward each other with the sheets therebetween with excess lengths of the studs extending beyond the female strip, first actuating means for said compression means, a cam, said cam having a groove, second actuating means for said cam, at least one carriage mounted for reciprocating movement relative to said frame parallel to the strips having a cam follower engaging said groove, said groove controlling movement of said carriage, stud bending means on said carriage movable with said carriage to bend the excess lengths of the studs at right angles and into the grooves.

2. A machine according to claim 1 in which said cam has a second groove and which further comprises a second carriage mounted for reciprocating movement opposite and aligned with said first-mentioned carriage so that said carriages move in opposite directions, said second carriage having second stud bending means.

3. A machine according to claim 1 in which said stud bending means comprises an arm extending from said carriage and a stud contractor on the distal end of said arm.

4. A machine according to claim 3 in which said contractor comprises a roller.

5. A machine according to claim 3 in which said contractor is located below the depression and at an elevation such that said contractor supports the female strip when seated in the depression.

6. A machine according to claim 3 in which said carriage has at least two arms, each said arm having a stud contractor.

7. A machine according to claim 1 in which said cam is a drum cam and said groove is formed as a depression into the cylindrical surface thereof.

8. A machine according to claim 1 which further comprises a cam shaft rotatable in said frame parallel to the depression, said cam being mounted on said cam shaft, said first actuating means having a second cam also mounted on said cam shaft.

9. A machine according to claim 8 which further comprises means to operate said second cam and said first-mentioned cam sequentially.

10. A machine according to claim 1 wherein the inner surface of the female strip is formed with a cavity and the outer surface has a flat surface opposite the cavity, said machine being driven by a motor and which further comprises interlock means below the depression having a feeler which discriminates between the cavity and the flat surface and disables said motor when it senses the cavity.

* * * * *